US011779509B2

(12) United States Patent
Inada et al.

(10) Patent No.: US 11,779,509 B2
(45) Date of Patent: Oct. 10, 2023

(54) MASSAGE MACHINE

(71) Applicant: FAMILY INADA CO., LTD., Osaka (JP)

(72) Inventors: Nichimu Inada, Osaka (JP); Ryo Kawakami, Tottori (JP)

(73) Assignee: FAMILY INADA CO., LTD., Osaka (JP)

( * ) Notice: Subject to any disclaimer, the term of this patent is extended or adjusted under 35 U.S.C. 154(b) by 641 days.

(21) Appl. No.: 16/654,594

(22) Filed: Oct. 16, 2019

(65) Prior Publication Data

US 2020/0121549 A1 Apr. 23, 2020

(30) Foreign Application Priority Data

Oct. 18, 2018 (JP) ..... 2018-196484

(51) Int. Cl.
*A61H 15/00* (2006.01)
*A61H 7/00* (2006.01)

(52) U.S. Cl.
CPC ..... *A61H 15/0078* (2013.01); *A61H 7/007* (2013.01); *A61H 2015/005* (2013.01); *A61H 2201/0149* (2013.01); *A61H 2201/1418* (2013.01); *A61H 2205/081* (2013.01)

(58) Field of Classification Search
CPC ..... A61H 15/00; A61H 15/0078; A61H 2201/0149; A61H 2201/1635; A61H 2201/1427; A61H 2205/081; A61H 23/006; A61H 7/007; A61H 9/0078
See application file for complete search history.

(56) References Cited

U.S. PATENT DOCUMENTS

2007/0016119 A1* 1/2007 Inada ..... A61H 9/0078 601/151
2010/0137758 A1* 6/2010 Nagamitsu ..... A61H 7/004 601/97
2010/0312155 A1* 12/2010 Fukuyama ..... A61H 9/0078 601/98

FOREIGN PATENT DOCUMENTS

JP 2016-101475 A 6/2016

* cited by examiner

*Primary Examiner* — Philip R Wiest
*Assistant Examiner* — Nathan M Le
(74) *Attorney, Agent, or Firm* — Michael Best & Friedrich LLP

(57) ABSTRACT

The massage machine includes a massage unit for treating a treatment target person, a first drive unit for driving the massage unit in a direction facing a treatment site of at least the treatment target person, and a control unit that controls driving of at least the first drive unit. The massage unit is configured to include a treatment unit in an articulated structure with at least two or more joints, and a second drive unit that drives the treatment unit in the direction facing the treatment target site of the treatment target person. The at least the two or more joints are shifted from each other in a direction intersecting a longitudinal direction of the treatment target site.

3 Claims, 14 Drawing Sheets

MASSAGE MACHINE

TECHNICAL FIELD

The present invention relates to a massage machine.

BACKGROUND ART

In the related art, a massage apparatus has been proposed which has a massage unit provided with a plurality of link members, an operating-purpose air cell for operating the link members, a massage-purpose air cell, and a spring (coil spring) serving as an elastic member.

The massage apparatus disclosed in Japanese Patent Application Publication No. JP-2016-101475-A includes the massage unit that has a first member and a second member which are disposed along a circumferential direction of a body part of a treatment target person, and in which one side of a space formed between the first member and the second member is open so as to allow free access of the body part. The massage unit further includes the air cell disposed together with the first member and inflated so as to press the body part, and a massage mechanism that performs an operation for relatively moving the first member and the second member close to each other, and an operation for moving the inflated air cell and the first member in a direction of at least one side between an opening side of the space and a side opposite thereto. A motion of a human hand is reproduced by the massage unit configured as described above. However, a motion of human wrist is not reproduced by the massage unit.

SUMMARY OF THE INVENTION

According to one of the aspects of the present invention, a massage machine includes a massage unit configured to treat a treatment target person, a first drive unit that drives the massage unit at least in a direction facing a treatment target site of the treatment target person, and a control unit that controls driving of at least the first drive unit. The massage unit includes a treatment unit in an articulated structure with at least two or more joints, and a second drive unit that drives the treatment unit at least in the direction facing the treatment target site. The at least the two or more joints are shifted from each other in a direction intersecting a longitudinal direction of the treatment target site.

In addition, it is preferable that a pair of the right and left massage units is disposed so as to pinch the treatment target site of the treatment target person. The first drive unit may be capable of driving the massage unit in a direction extending along the treatment target site.

The first drive unit may have a motor, a drive shaft that transmits a rotational movement of the motor, and a conversion member that converts the rotational movement of the drive shaft into an oscillating movement of the treatment unit.

In addition, the treatment unit may include an outer treatment unit located relatively outward and an inner treatment unit located relatively inward. The second drive unit may include a second outer drive unit that drives the outer treatment unit, and a second inner drive unit that drives the inner treatment unit.

According to the present invention, the motion of the human hand and the motion of the human wrist may be reproduced.

BRIEF DESCRIPTION OF THE DRAWINGS

FIG. 9A is a front view, and FIG. 9B is a plan view.

FIG. 10A is a front view, and FIG. 10B is a plan view.

FIG. 11A is a front view, and FIG. 11B is a plan view.

FIG. 12A is a front view, and FIG. 12B is a plan view.

DETAILED DESCRIPTION OF THE INVENTION

Configuration of Massage Machine According to Embodiment

Figure 1:
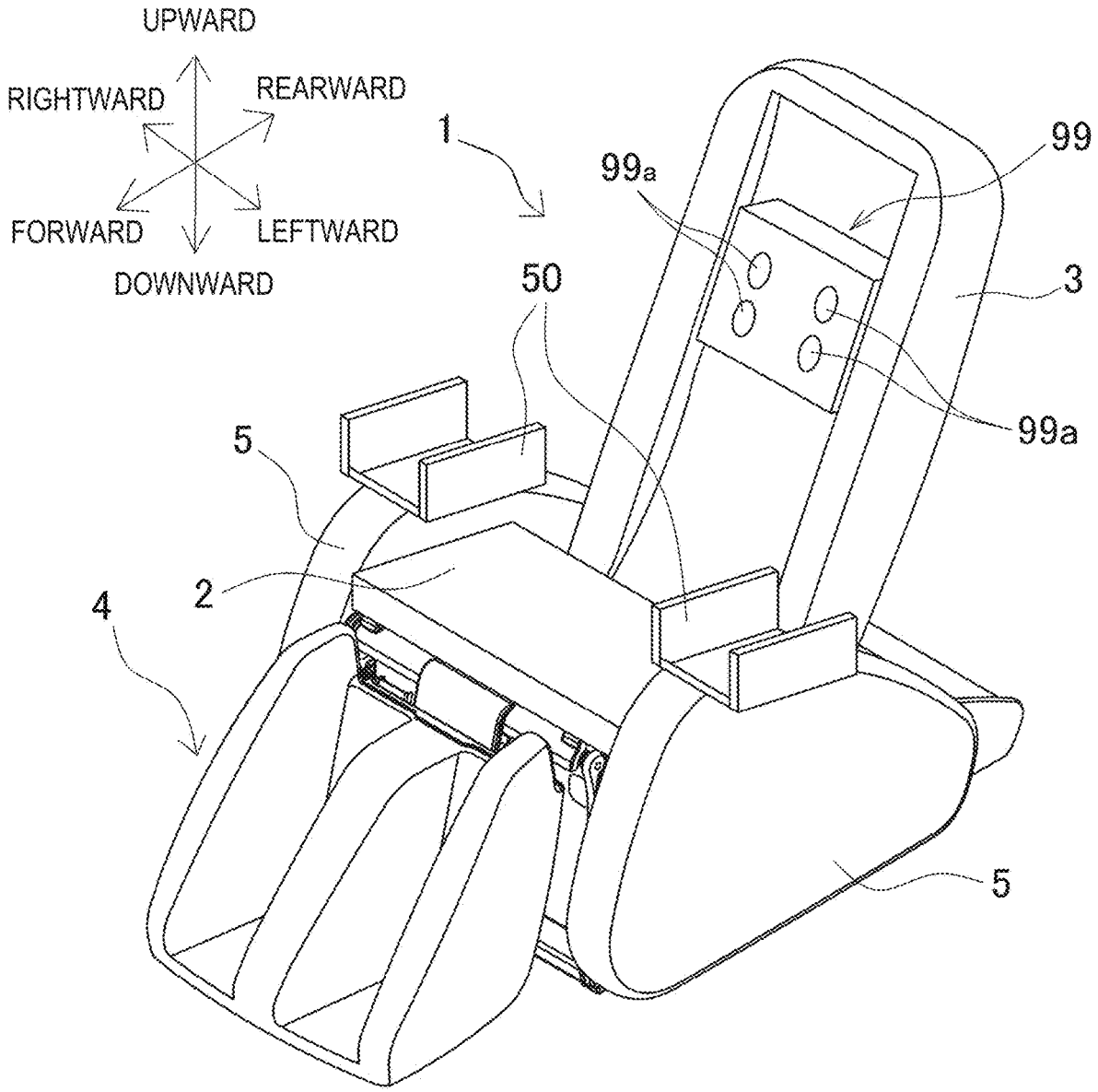
FIG. 1 is a front perspective view of a massage machine according to an embodiment of the present invention.
Figure 2:
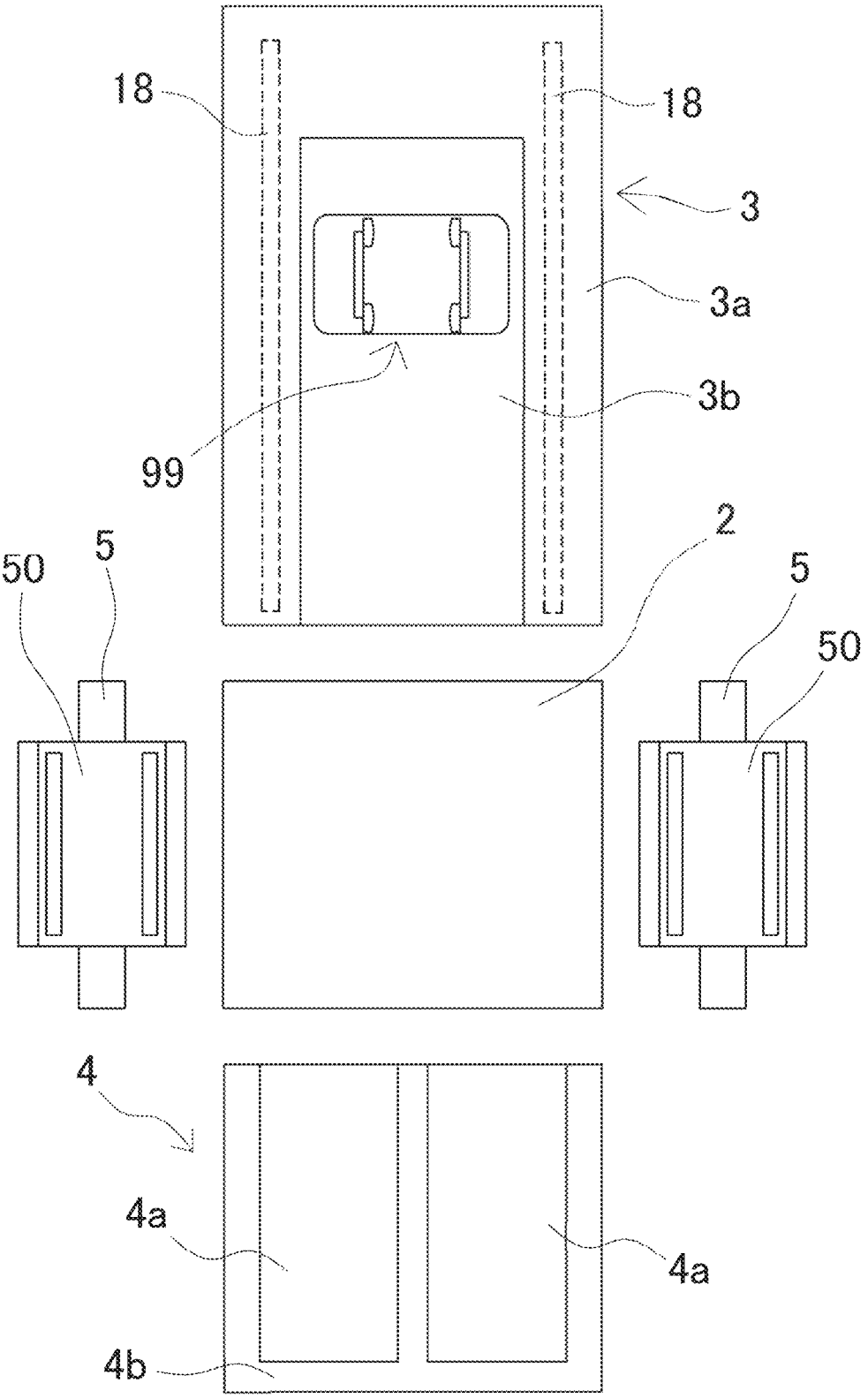
FIG. 2 is a schematic view of the massage machine according to the embodiment of the present invention.
Figure 3:
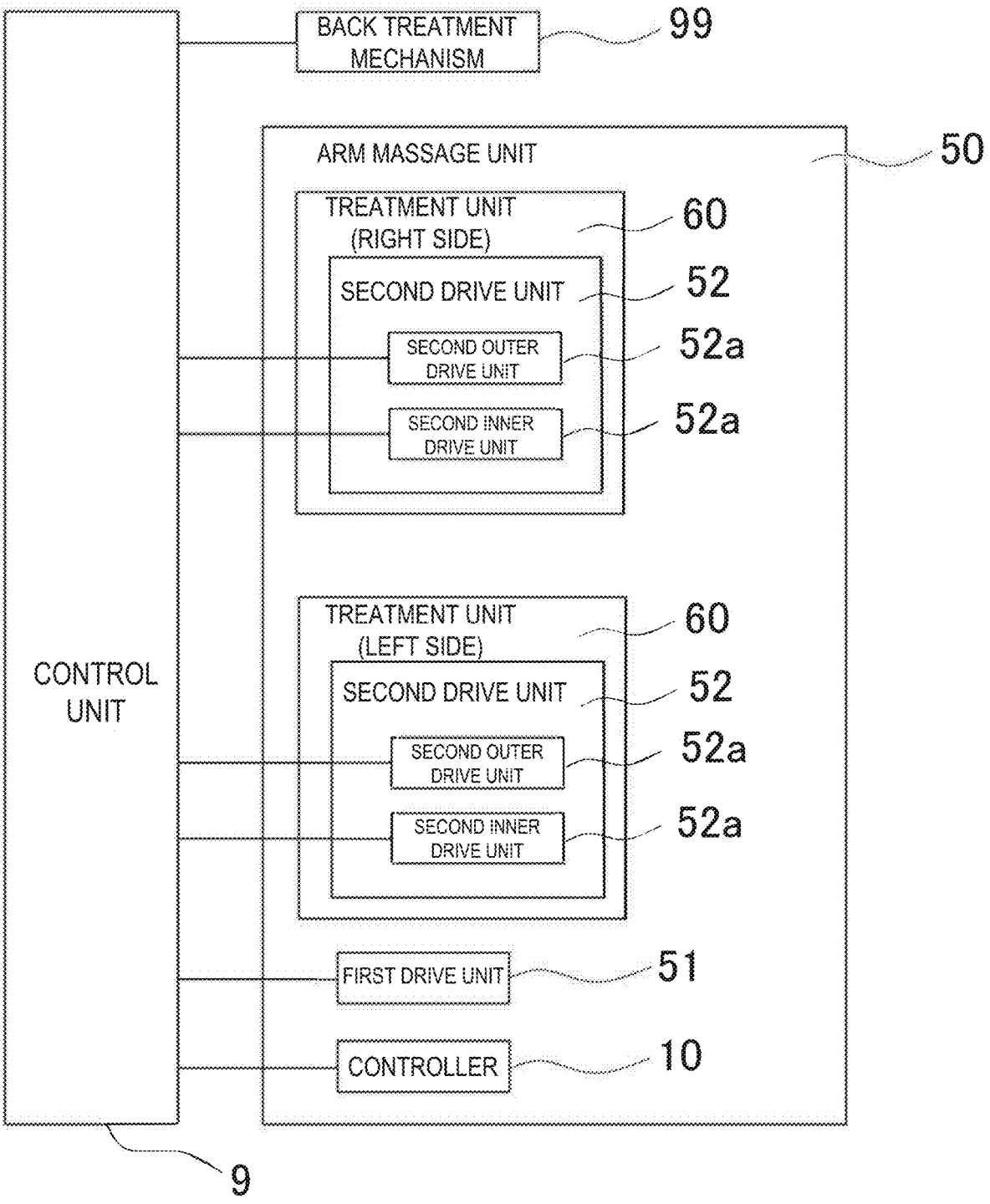
FIG. 3 is a functional block diagram of the massage machine.

Hereinafter, an overall configuration of a massage machine 1 according to an embodiment of the present invention will be described. FIG. 1 is a front perspective view of the massage machine 1 according to the embodiment of the present invention. FIG. 2 is a schematic view of the massage machine 1 according to the embodiment of the present invention. FIG. 3 is a functional block diagram of the massage machine 1.

A concept of directions used in the following description coincides with a concept of directions when viewed from a treatment target person sitting on the massage machine 1 illustrated in FIG. 1. In other cases, the concept will be appropriately described. In addition, description will be made as follows. In a case of simply describing the inside or the outside, a side close to the treatment target person will be referred to as the inside in a rightward-leftward direction, and a side opposite thereto will be referred to as the outside.

Overall Configuration of Massage Machine

As illustrated in FIGS. 1 to 3, the massage machine 1 according to the embodiment of the present invention mainly has a seat unit 2 on which the treatment target person sits, a backrest unit 3 disposed in a rear part of the seat unit 2 so as to be capable of reclining and against which the treatment target person leans, a footrest 4 disposed in a front part of the seat unit 2 disposed so as to be capable of oscillating upward and downward and supporting lower limbs of the treatment target person, and armrest units 5 respectively disposed on both right and left sides of the seat unit 2. The seat unit 2, the backrest unit 3, the footrest 4, and the armrest unit 5 function as body support units that support a body of the treatment target person. The massage machine 1 has a back treatment mechanism 99 that performs kneading massage and/or tapping massage by using the backrest unit 3, an arm massage unit 50 serving as a massage unit that performs massage by pinching an arm of the treatment target person, a control unit 9 that controls each operation of the massage machine 1, and a controller 10 that allows the treatment target person to perform various operations (to be described later).

In the present embodiment, a case of the arm massage unit 50 in which the massage unit is disposed in the armrest unit 5 will be described.

The control unit 9 has a programmable microcomputer, and performs drive control on the back treatment mechanism 99, the treatment unit 60 configuring the arm massage unit 50, the first drive unit 51 for driving the arm massage unit 50. The control unit 9 is electrically connected to the controller 10 (to be described later). The massage machine 1 operates the back treatment mechanism 99 and the arm massage unit 50 in accordance with a predetermined program (massage course) stored in the control unit 9, and further, is operated in accordance with an instruction from the controller 10 which is input by the treatment target person (to be described later).

Configuration of Seat Unit

As illustrated in FIGS. 1 to 3, the footrest 4 (to be described later) is attached to a front side of the seat unit 2 via an oscillating shaft (not illustrated) so as to be capable of freely oscillating with respect to the seat unit 2 in an upward-downward direction. In addition, the backrest unit 3 (to be described later) is attached to a rear side of the seat unit 2 via an oscillating shaft (not illustrated) so as to be capable of freely reclining with respect to the seat unit 2 in a forward-rearward direction. In addition, the armrest units 5 are respectively attached to both right and left sides of the seat unit 2.

Although not illustrated, a massage unit for performing massage on a gluteal region and/or a femoral region of the treatment target person may be disposed in the seat unit 2.

Configuration of Backrest Unit

As illustrated in FIGS. 1 to 3, the backrest unit 3 is configured to include a rigid back frame 3*a*, a guide rail 18 that guides ascending/descending of the back treatment mechanism 99 assembled to the back frame 3*a*, and a cover member (not illustrated) that covers the back frame 3*a*. The back frame 3*a* has an opening 3*b* which is formed at the center in the rightward-leftward direction and which is open in the forward-rearward direction, and has a substantially portal shape in a front view. In addition, the cover member (not illustrated) is attached to a front portion of the opening 3*b* so as to cover the opening 3*b*. A treatment element 99*a* (refer to FIG. 1) of the back treatment mechanism 99 protrudes forward from the opening 3*b*, and can perform massage on the body of the treatment target person from the rear side via the cover member (not illustrated). For example, the back treatment mechanism 99 has four kneading balls. The back treatment mechanism 99 performs massage on a back of the treatment target person by using the kneading balls while moving upward and downward along the guide rail 18.

Configuration of Footrest

As illustrated in FIGS. 1 to 3, the footrest 4 has a pair of right and left grooves 4*a* respectively supporting lower thighs of the treatment target person, and a pair of right and left foot plates 4*b* respectively supporting feet of the treatment target person. The groove 4*a* of the footrest 4 extends downward when viewed from the seat unit 2. Although not illustrated, a massage unit for performing massage on the lower thigh and/or the foot of the treatment target person may be disposed in each location of the groove 4*a* and the foot plate 4*b*.

Configuration of Controller

As illustrated in FIG. 3, the controller 10 is connected to the control unit 9. The treatment target person can change a posture of the backrest unit 3 or a posture of the footrest 4 by operating the controller 10. In addition, the treatment target person can select the back treatment mechanism 99 and the arm massage unit 50 to be operated, or can change each operation (procedure or strength) of the back treatment mechanism 99 and the arm massage unit 50.

Configuration of Armrest Unit

As illustrated in FIGS. 1 and 2, each of a pair of the armrest units 5 is provided on both right and left sides of the seat unit 2. The armrest unit 5 extends upward from the seat unit 2. The arm massage unit 50 (to be described later) is attached to an upper portion of the armrest unit 5. The treatment target person can receive the massage for the arm by laying the arm on the arm massage unit 50.

Figure 4:
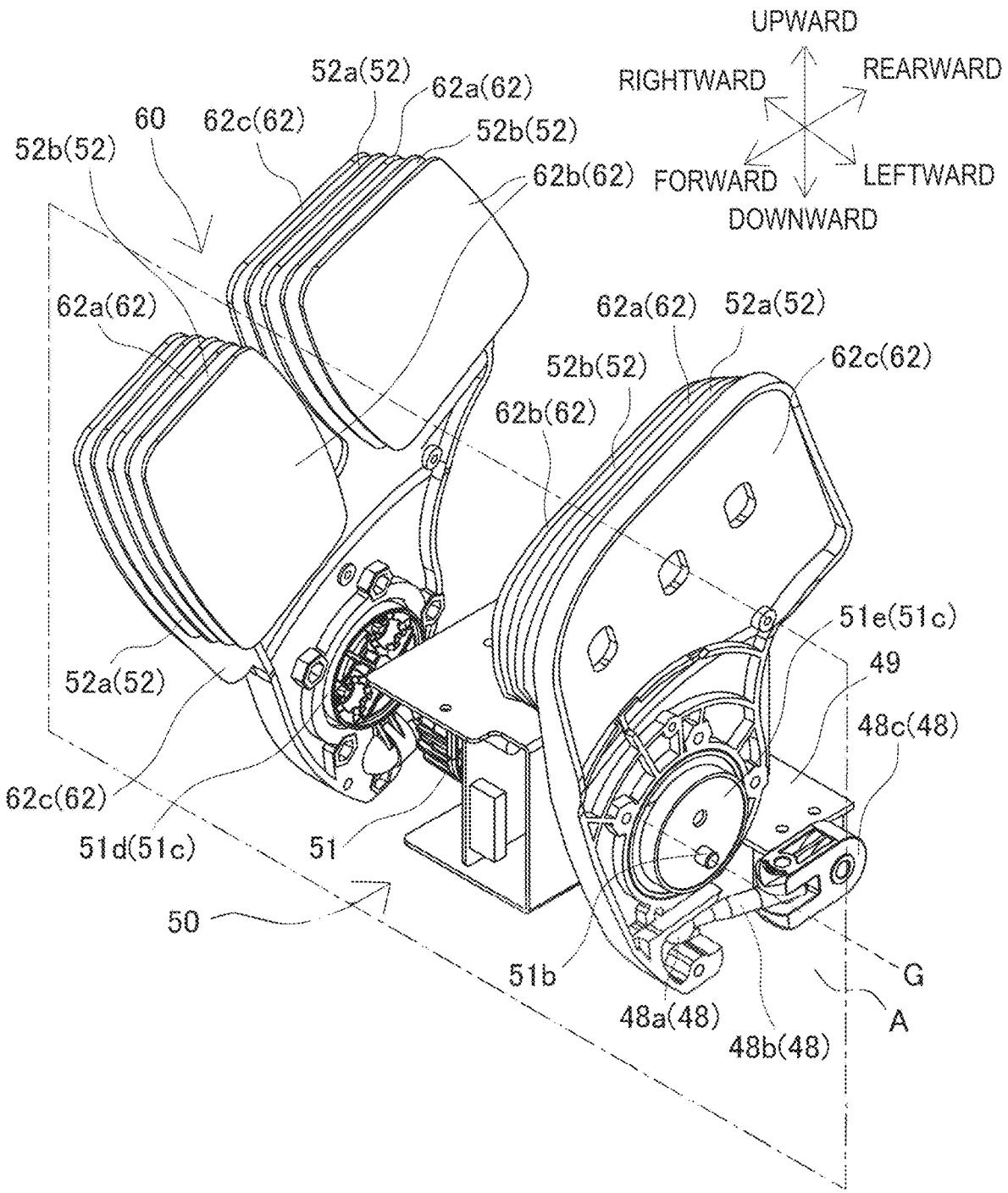
FIG. 4 is a front perspective view of an arm massage unit disposed in a right side armrest unit.
Figure 5:
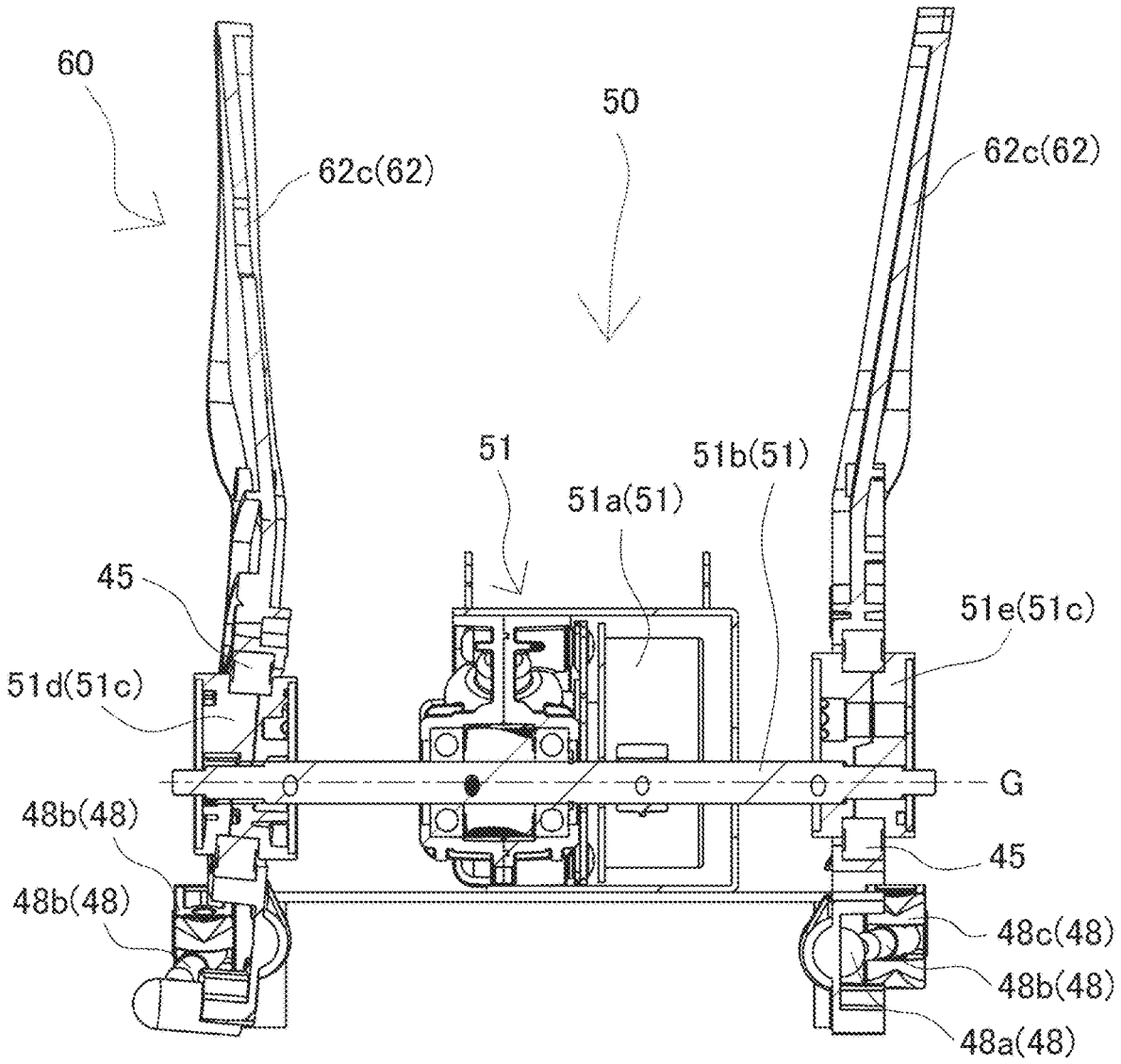
FIG. 5 is a front view of a cross section in which the arm massage unit disposed in the right side armrest unit is cut by a plane A.
Figure 6:
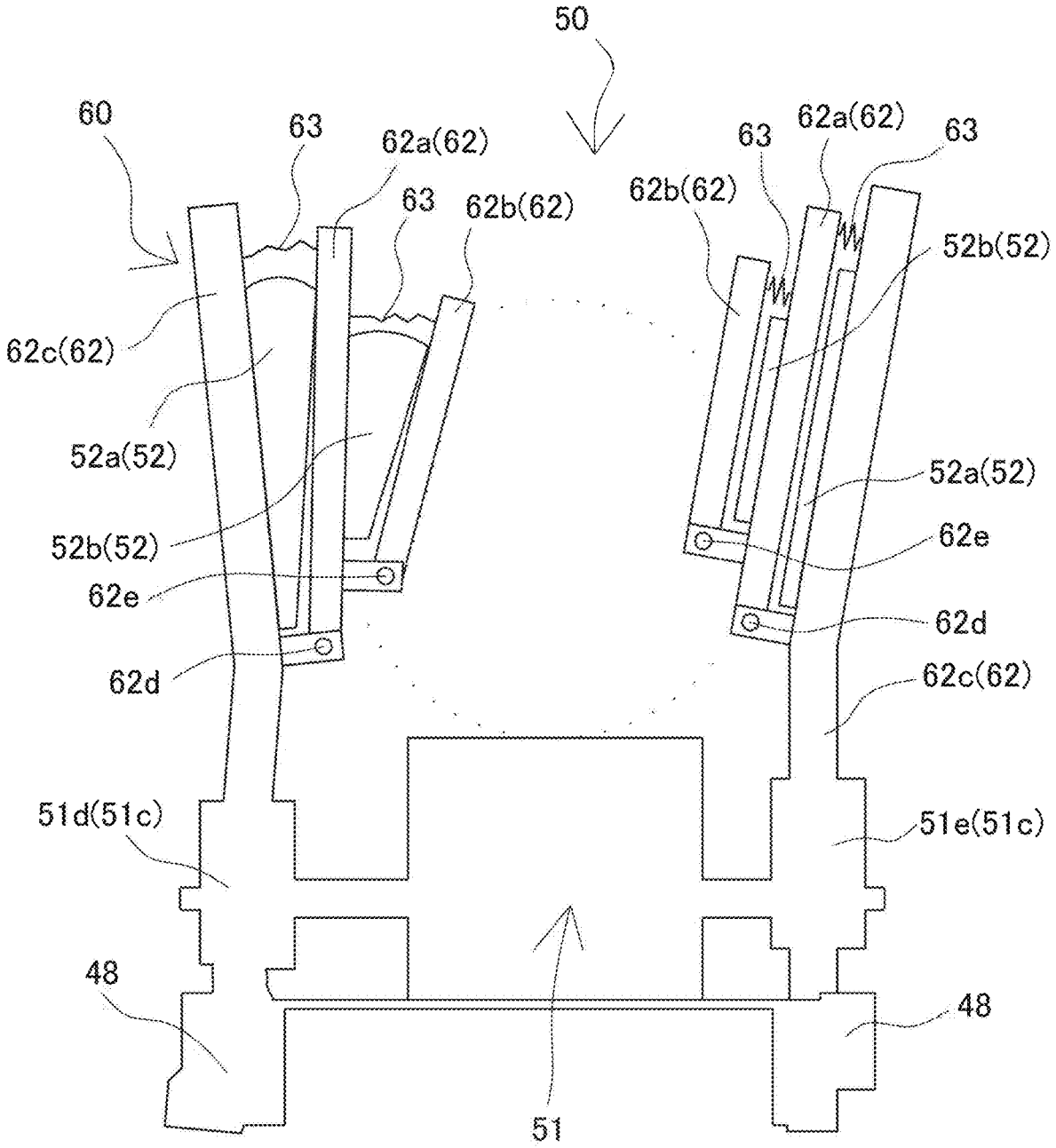
FIG. 6 is a schematic view of the arm massage unit disposed in the right side armrest unit, and illustrates a state where a second outer drive unit and a second inner drive unit are driven.
Figure 7:
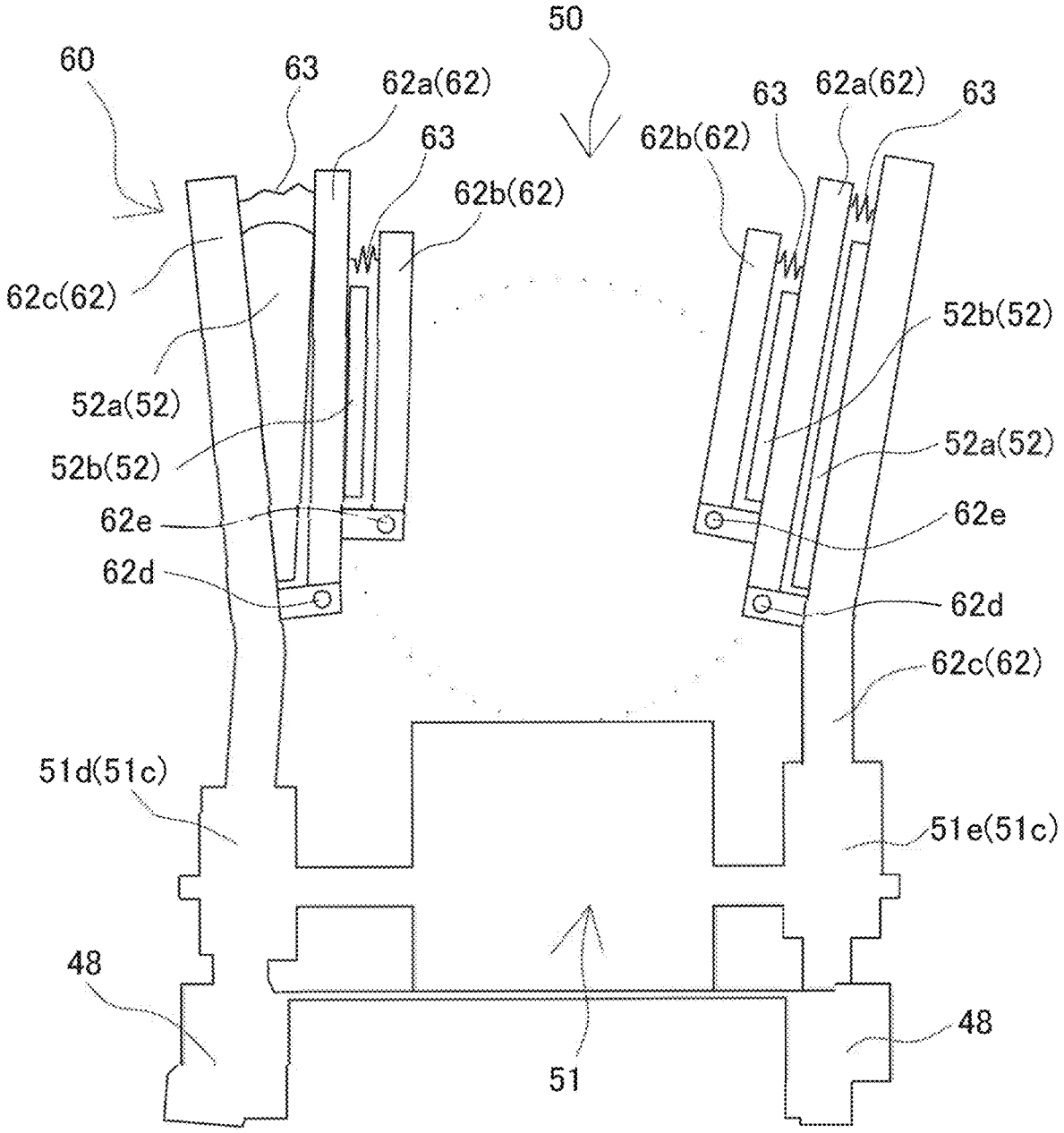
FIG. 7 is a schematic view of the arm massage unit disposed in the right side armrest unit, and illustrates a state where the second outer drive unit is driven.
Figure 8:
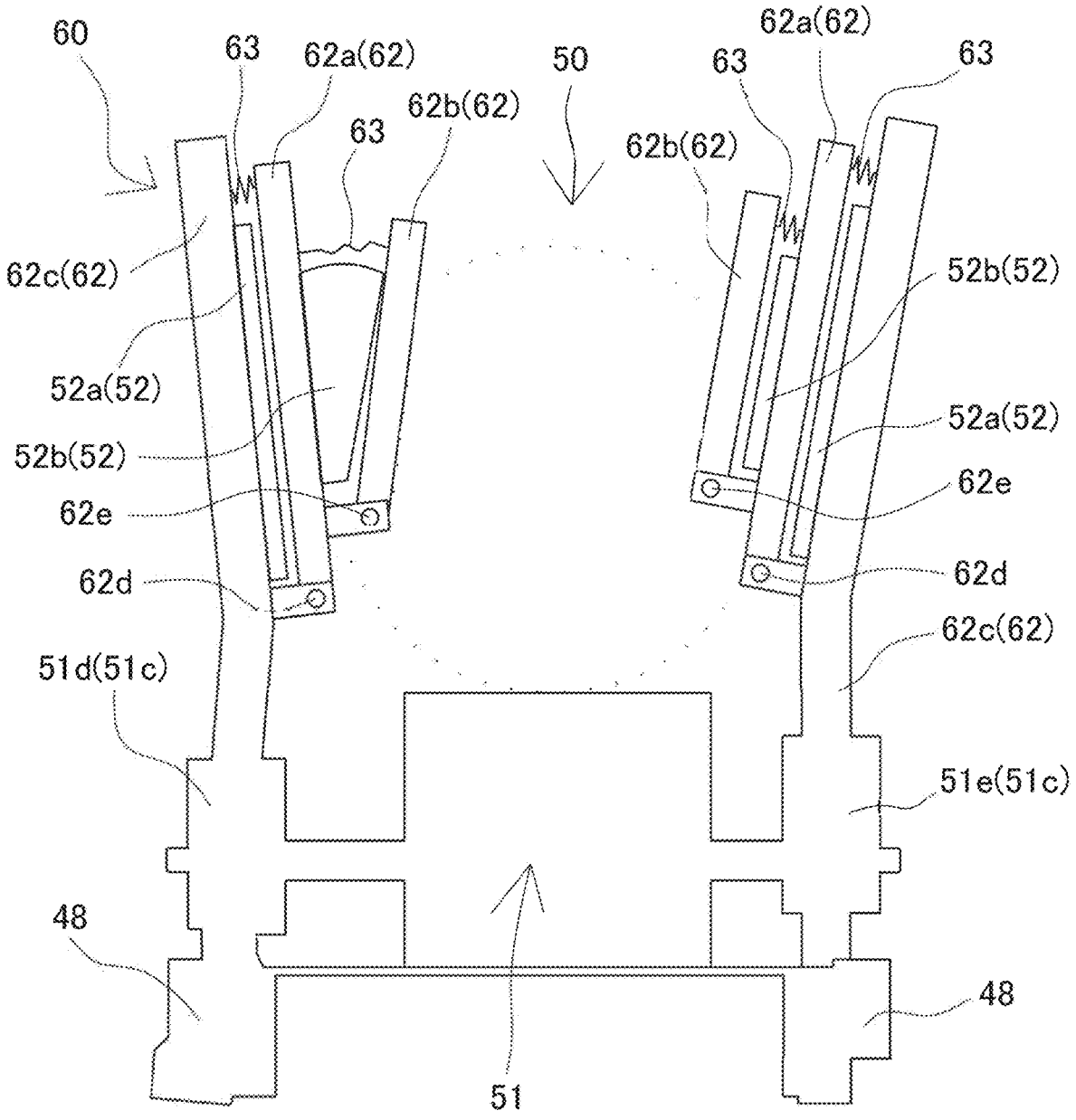
FIG. 8 is a schematic view of the arm massage unit disposed in the right side armrest unit, and illustrates a state where the second inner drive unit is driven.
Figure 9A:
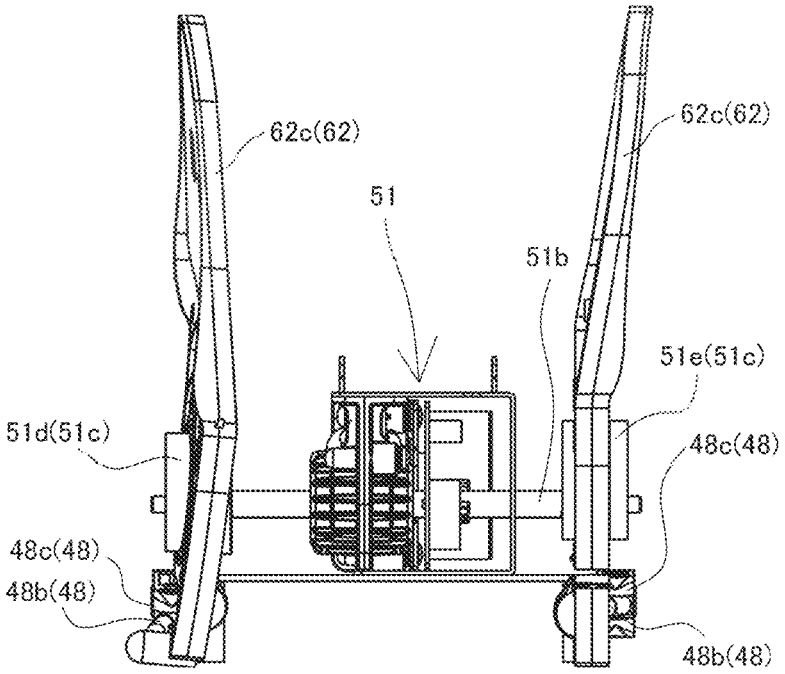
FIGS. 9A and 9B are views in which a joint is omitted from the right side arm massage unit in a first state.
Figure 9B:
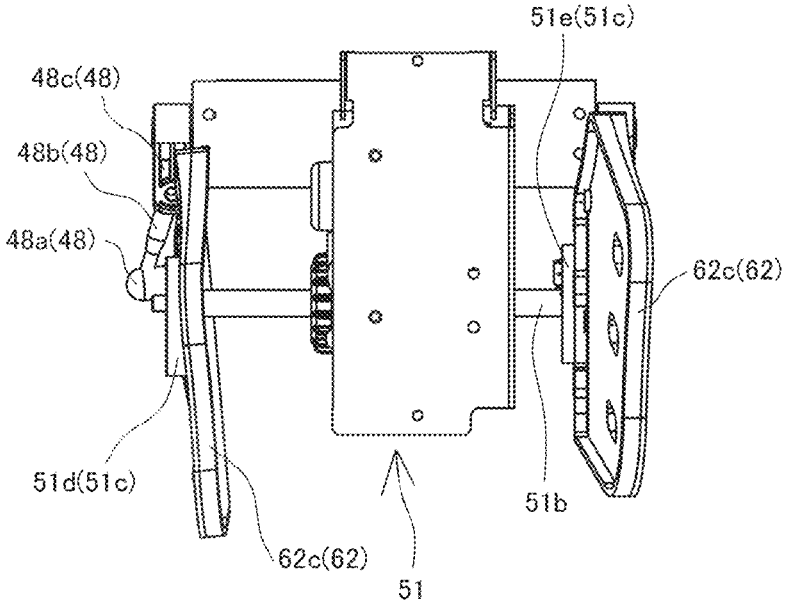
Figure 10A:
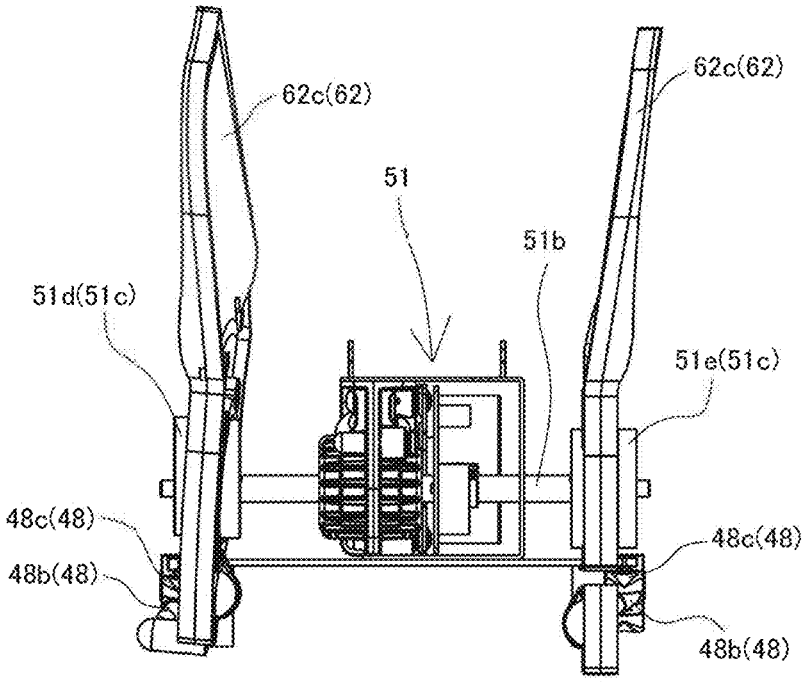
FIGS. 10A and 10B are views in which the joint is omitted from the right side arm massage unit in a second state.
Figure 10B:
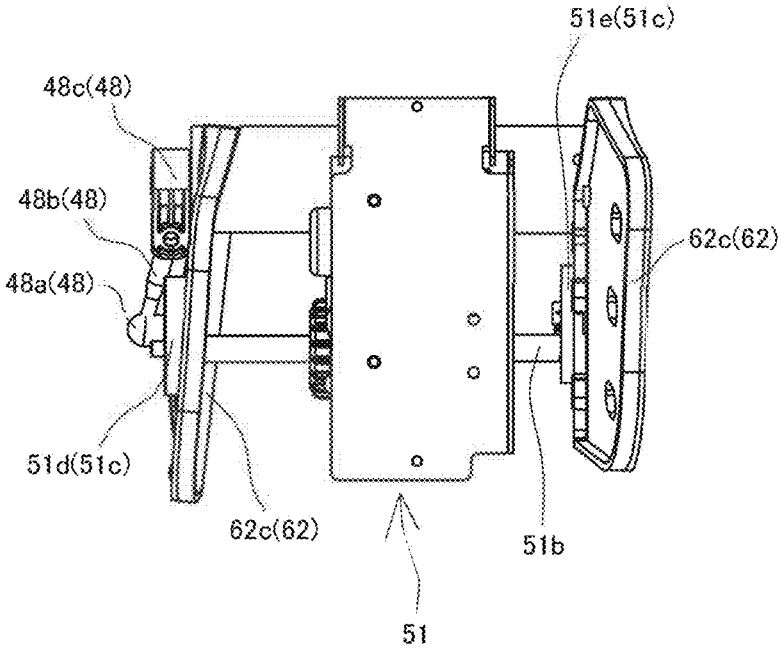
Figure 11A:
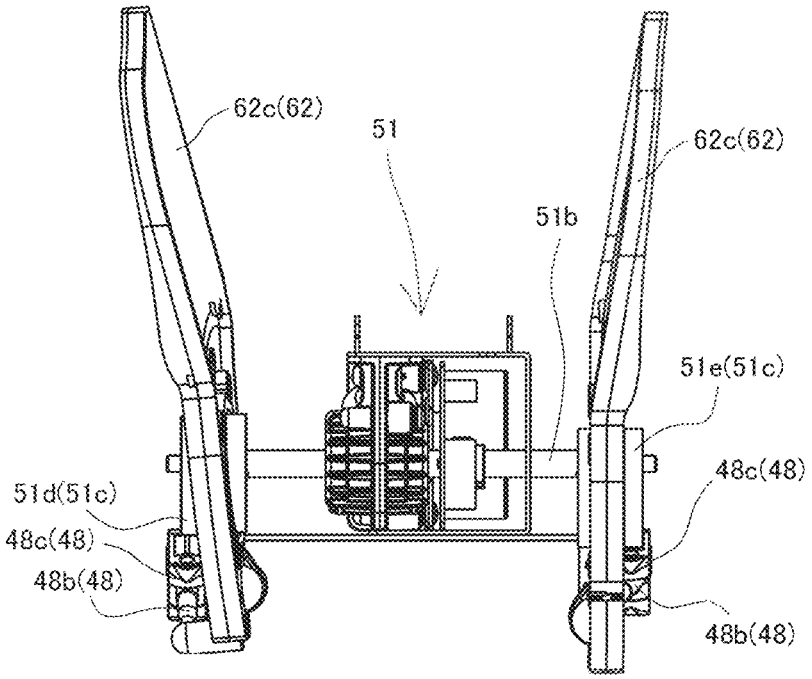
FIGS. 11A and 11B are views in which the joint is omitted from the right side arm massage unit in a third state.
Figure 11B:
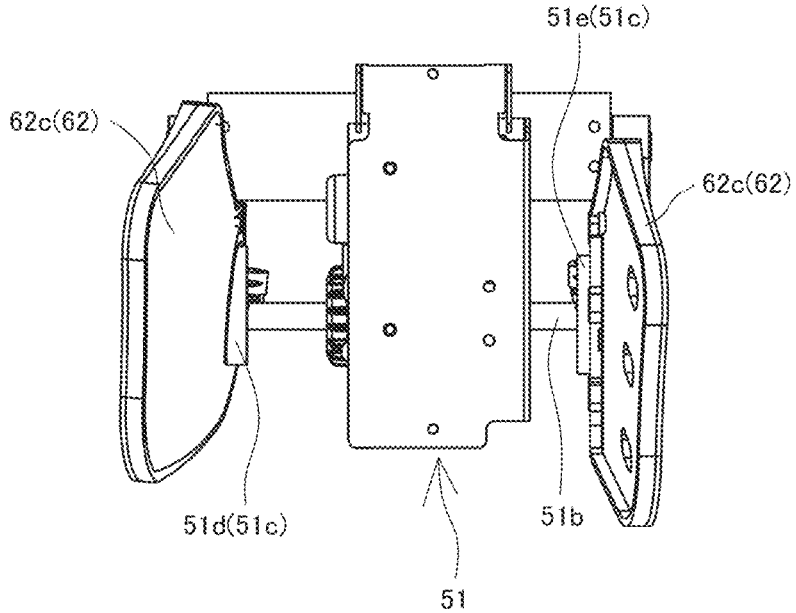
Figure 12A:
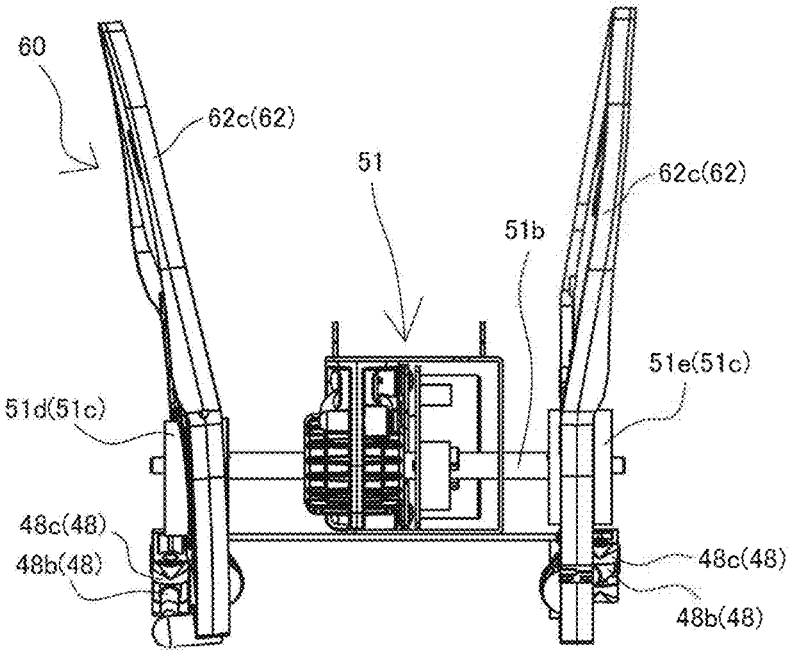
FIGS. 12A and 12B are views in which the joint is omitted from the right side arm massage unit in a fourth state.
Figure 12B:
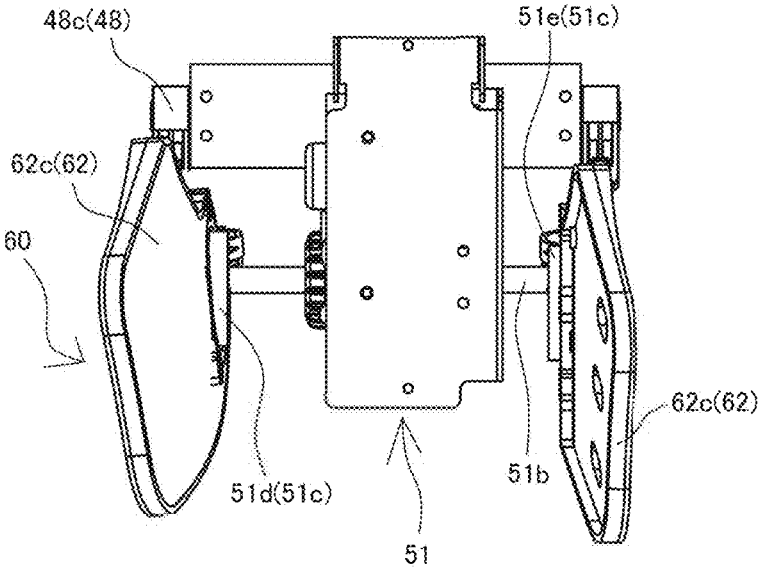

FIG. 4 is a front perspective view of the arm massage unit 50 disposed in the right side armrest unit 5. FIG. 5 is a front view of a cross section in which the arm massage unit 50 disposed in the right side armrest unit 5 is cut by a plane A. FIG. 6 is a schematic view of the arm massage unit 50 disposed in the right side armrest unit 5, and illustrates a state where a second outer drive unit 52*a* and a second inner drive unit 52*b* are driven. FIG. 7 is a schematic view of the arm massage unit 50 disposed in the right side armrest unit 5, and illustrates a state where the second outer drive unit 52*a* is driven. FIG. 8 is a schematic view of the arm massage unit 50 disposed in the right side armrest unit 5, and illustrates a state where the second inner drive unit 52*b* is driven. FIGS. 9A and 9B are views in which a joint 62 is omitted from the right side arm massage unit 50 in a first state. FIG. 9A is a front view, and FIG. 9B is a plan view. FIGS. 10A and 10B are views in which the joint 62 is omitted from the right side arm massage unit 50 in a second state. FIG. 10A is a front view, and FIG. 10B is a plan view. FIGS. 11A and 11B are views in which the joint 62 is omitted from the right side arm massage unit 50 in a third state. FIG. 11A is a front view, and FIG. 11B is a plan view. FIGS. 12A and 12B are views in which the joint 62 is omitted from the right side arm massage unit 50 in a fourth state. FIG. 12A is a front view, and FIG. 12B is a plan view.

Configuration of Arm Massage Unit

Hereinafter, a configuration of the right side arm massage unit 50 will be described. The left side arm massage unit 50 has the same configuration as the right side arm massage unit 50, and thus, description thereof will be omitted.

As illustrated in FIGS. 3 to 12B, the arm massage unit 50 is configured to include a first drive unit 51 for driving the arm massage unit 50 in a direction facing a treatment target site of at least the treatment target person and a direction extending along the treatment target site, a treatment unit 60 including an articulated structure having at least two or more joints, and a second drive unit 52 for driving the treatment unit 60 in a direction facing the treatment target site of at least the treatment target person. In addition, a pair of the right and left arm massage units 50 is disposed so as to pinch the treatment target site of the treatment target person.

Configuration of Treatment Unit

As illustrated in FIGS. 3 to 12, the treatment unit 60 includes the articulated structure having at least two or more joints 62. The treatment unit 60 has an outer treatment unit 62*a* disposed to face the treatment target site of the treatment target person and located relatively outward, and an inner treatment unit 62*b* located relatively inward. The outer treatment unit 62*a* and the inner treatment unit 62*b* are configured to include a plate-shaped member.

Configuration of First Drive Unit

As illustrated in FIG. 5, the first drive unit 51 has a motor 51*a*, a drive shaft 51*b* that transmits a rotational movement of the motor 51*a* to a treatment plate 62*c* (to be described later), and a conversion member 51*c* that converts the rotational movement of motor 51*a* which is transmitted from the drive shaft 51*b* into an oscillating movement of the treatment plate 62*c*. The conversion member 51*c* is an eccentric deflection angle cam 51*d* for causing the treatment plate 62*c* to oscillate in upward-downward direction and the rightward-leftward direction, and an eccentric cam 51*e* for causing the treatment plate 62*c* to oscillate in the upward-downward direction and the forward-rearward direction.

In the present embodiment, the conversion member 51*c* attached to the treatment plate 62*c* located outside the arm is configured to include the eccentric deflection angle cam 51*d*, and the conversion member 51*c* attached to the treatment plate 62*c* located inside the arm is configured to include the eccentric cam 51*e*.

The conversion member 51*c* may be any member that can convert the rotational movement of the motor 51*a* which is transmitted from the drive shaft 51*b* into the oscillating movement of the treatment plate 62*c*. For example, the conversion member 51*c* of the treatment plate 62*c* located relatively outward may be configured to include the eccentric cam 51*e*, and the conversion member 51*c* of the treatment plate 62*c* located relatively inward may be configured to include the eccentric deflection angle cam 51*d*. In addition, the conversion member 51*c* of the treatment plate 62*c* located relatively outward and the conversion member 51*c* of the treatment plate 62*c* located relatively inward may be configured to include the eccentric deflection angle cam 51*d*.

According to this configuration, the treatment plate 62*c* can three-dimensionally move. Therefore, it is possible to reproduce the motion of the human wrist.

Configuration of Joint

As illustrated in FIGS. 6 to 8, at least two or more joints 62 configuring the treatment unit 60 are configured to include the outer treatment unit 62*a* located relatively outward, the inner treatment unit 62*b* located relatively inward, and the treatment plate 62*c* to which the outer treatment unit 62*a* and the inner treatment unit 62*b* are attached. The number of the joints 62 may be at least two or more.

In the embodiment, two joints 62 are provided. In addition, the respective joints 62 are shifted from each other in a direction intersecting a longitudinal direction of the treatment target site of the treatment target person. A plurality of the joints 62 are shifted from each other in a direction orthogonal to the longitudinal direction of the treatment target site of the treatment target person. In this manner, it is possible to reproduce the fingers of the human hand. In the present embodiment, the plurality of joints 62 are shifted from each other for the treatment target site in the upward-downward direction.

The outer treatment unit 62*a* is attached to the treatment plate 62*c* via an outer oscillating shaft 62*d* so as to freely oscillate. A biasing member 63 (to be described later) is attached between an upper portion of the outer treatment unit 62*a* and an upper portion of the treatment plate 62*c*. The outer treatment unit 62*a* is biased by the biasing member 63 in a direction closer to the treatment plate 62*c* (direction away from the treatment target site of the treatment target person.

The inner treatment unit 62*b* is attached to the outer treatment unit 62*a* via an inner oscillating shaft 62*e* so as to freely oscillate. The biasing member 63 (to be described later) is attached between an upper portion of the inner treatment unit 62*b* and an upper portion of the outer treatment unit 62*a*. The inner treatment unit 62*b* is biased by the biasing member 63 in a direction closer to the outer treatment unit 62*a* (direction away from the treatment target site of the treatment target person).

The treatment plate 62*c* is located outside the outer treatment unit 62*a*. The treatment plate 62*c* is configured to include the plate-shaped member. The treatment plate 62*c* extends upward. The treatment plate 62*c* is curved to be inclined with respect to the first drive unit 51 outward from the vicinity of the center (refer to FIG. 5). The first drive unit 51 is attached to the lower portion of the treatment plate 62*c* via the conversion member 51*c*. As illustrated in FIG. 4, in the present embodiment, the treatment plate 62*c* located outward is configured to include a substantially Y-shaped and plate-shaped member having bifurcated tip portions. The outer treatment unit 62*a* and the inner treatment unit 62*b* are attached to the respective tip portion. In addition, the treatment plate 62*c* located inward is configured to include a substantially L-shaped and plate-shaped member extending rearward.

According to this configuration, the treatment plate 62*c* located outward can reproduce the four fingers of the human hand, and the treatment plate 62*c* located inward can reproduce the thumb of the human hand.

Configuration of Second Drive Unit

As illustrated in FIGS. 4 and 6 to 8, the second drive unit 52 is configured to include an air cell. The second drive unit 52 is configured to include the second outer drive unit 52*a* located relatively outward and the second inner drive unit 52*b* located relatively inward. The second outer drive unit 52*a* and the second inner drive unit 52*b* can be driven independently of each other. The second drive unit 52 is driven, thereby enabling the joint 62 biased by the biasing member 63 to oscillate in a direction closer to the treatment target site of the treatment target person.

According to this configuration, the motion of at least two or more joints configuring the treatment unit 60 can be smooth. Accordingly, the motion of the joints can be closer to the motion of the fingers of the human hand.

Configuration of Biasing Member

As illustrated in FIGS. 6 to 8, the joint 62 has the biasing members 63 for biasing the treatment unit 60 in a direction away from the treatment target site of the treatment target person. Specifically, one biasing member is disposed between the upper portion of the treatment plate 62*c* and the upper portion of the outer treatment unit 62*a*, and one biasing member is disposed between the upper portion of the outer treatment unit 62*a* and the upper portion of the inner treatment unit 62*b*.

The biasing member 63 is configured to include a tension spring. The biasing member 63 biases the joint 62 in the direction away from the treatment target site of the treatment target person. The second drive unit 52 is turned on or off to be driven, thereby enabling the joint 62 to move close to or to move away from the treatment target site of the treatment target person. That is, when the second drive unit 52 is not in a driven state, the joint 62 can be prevented from coming into contact with the treatment target site. In addition, a motion of pulling/kneading performed by the human hand can be reproduced by being combined with the driving of the second drive unit 52.

In the present embodiment, the biasing member 63 is configured to include the tension spring. However, without being limited to the above-described configuration, any configuration may be adopted as long as the treatment unit 60 can be biased in the direction away from the treatment target site of the treatment target person. For example, a double torsion spring may be adopted. In this case, the motion of pulling/kneading can be realized by attaching the double torsion spring to the outer oscillating shaft 62*d* or the inner oscillating shaft 62*e*.

An operation of the conversion member 51*c* will be described. As illustrated in FIGS. 9A to 12B, the drive shaft 51*b* has a rotation axis G (refer to FIG. 5) that is a rotation axis extending along the rightward-leftward direction. The conversion members 51*c* are respectively attached to both end portions of the drive shaft 51*b* in the rightward-leftward direction. The attached conversion members 51*c* are different from each other on the right and left sides. The conversion member 51*c* located relatively outward is the eccentric deflection angle cam 51*d*. The conversion member 51*c* located relatively inward is the eccentric cam 51*e*. The drive shaft 51*b* is rotated in proportion to the rotation speed of the motor 51*a*.

The conversion member 51*c* has a bearing 45 (refer to FIG. 5) and a link mechanism 48 which regulates an operation range in the rotation direction of the conversion member 51*c* attached to the treatment plate 62*c* to fall within a predetermined range so that the treatment plate 62*c* is not rotated by the rotation of the drive shaft 51*b* and which allows the treatment plate 62*c* to be operated in the axial direction of the rotation axis G of the drive shaft 51*b*.

As illustrated in FIG. 4, the link mechanism 48 has a spherical end portion 48*a*, a first member 48*b* that can pivot in the rightward-leftward direction, and a second member 48*c* that can pivot in the upward-downward direction. The end portion 48*a* is connected to the lower portion of the treatment plate 62*c* by using a ball joint method with a spherical hole. The second member 48*c* is pivotally supported by a support member 49.

An operation in a case where the conversion member 51*c* is the eccentric cam 51*e* will be described. As illustrated in FIG. 5, the axis of the eccentric cam 51*e* is attached to the rotation axis G of the drive shaft 51*b* while being shifted therefrom. The treatment plate 62*c* is interlocked with the link mechanism 48.

If the drive shaft 51*b* is rotated, the rotational movement of the drive shaft 51*b* is transmitted to the treatment plate 62*c* via the link mechanism 48. The treatment plate 62*c* is interlocked with the link mechanism 48. Accordingly, the treatment plate 62*c* can oscillate in the forward-rearward direction and the upward-downward direction with respect to the drive shaft 51*b* without being rotated in synchronization therewith.

An operation in a case where the conversion member 51*c* is the eccentric deflection angle cam 51*d* will be described. As illustrated in FIG. 5, the rotation axis of the eccentric deflection angle cam 51*d* is attached to the rotation axis G while being inclined therefrom. The treatment plate 62*c* is interlocked with the link mechanism 48.

If the drive shaft 51*b* is rotated, the rotational movement of the drive shaft 51*b* is transmitted to the treatment plate 62*c* via the link mechanism 48. The treatment plate 62*c* is interlocked with the link mechanism 48. Accordingly, the treatment plate 62*c* can oscillate in the forward-rearward direction and the rightward-leftward direction and upward-downward direction with respect to the drive shaft 51*b* without being rotated in synchronization therewith.

As illustrated in FIGS. 9A to 12B, the arm massage unit 50 oscillates in synchronization with the oscillation of the conversion member 51*c*. The right and left treatment plates 62*c* oscillate by driving the first drive unit 51.

An oscillating operation of the outer treatment plate 62*c* will be described. The outer treatment plate 62*c* is attached via the eccentric deflection angle cam 51*d*. If the first drive unit 51 is driven, as illustrated in FIGS. 9A and 9B, the treatment plate 62*c* reaches an innermost (right side) position (hereinafter, referred to as a first state). Subsequently, if the first drive unit 51 is driven, as illustrated in FIGS. 10A and 10B, the treatment plate 62*c* moves to an uppermost position and rearward to the left side, compared to the first state (hereinafter referred to as a second state). Subsequently, if the first drive unit 51 is driven, as illustrated in FIGS. 11A and 11B, the treatment plate 62*c* is located at an outermost (left side) position and at a lower position compared to the second state in the upward-downward direction, and moves forward, compared to the first state and the second state (hereinafter, referred to as a third state). Subsequently, if the first drive unit 51 is driven, as illustrated in FIGS. 12A and 12B, the treatment plate 62*c* moves to a lowermost position and rightward, compared to the third state (hereinafter, referred to as a fourth state). Compared to the first state, the treatment plate 62*c* is located at a lower position in the upward-downward direction, and moves rightward. The fourth state moves forward compared to the third state. The fourth state is a state where the treatment plate 62*c* is located in a foremost end in an oscillating range of the treatment plate 62*c*.

An oscillating operation of the inner treatment plate 62*c* will be described. The inner treatment plate 62*c* is attached via the eccentric cam 51*e*. If the first drive unit 51 is driven, as illustrated in FIGS. 9A and 9B, the treatment plate 62*c* reaches a highest position (hereinafter, referred to as the first state). Subsequently, if the first drive unit 51 is driven, as illustrated in FIGS. 10A and 10B, the treatment plate 62*c* moves most rearward and to a lower position, compared to the first state (hereinafter referred to as the second state). Subsequently, if the first drive unit 51 is driven, as illustrated in FIGS. 11A and 11B, the treatment plate 62*c* moves to a lowest position and forward, compared to the second state (hereinafter, referred to as the third state). Subsequently, if the first drive unit 51 is driven, as illustrated in FIGS. 12A and 12B, the treatment plate 62*c* is moved most forward and to a higher position, compared to the third state (hereinafter, referred to as the fourth state).

In this way, the arm massage unit 50 performs massage on the human body by driving the second drive unit 52 while oscillating sequentially from the first state to the fourth state. In this case, the arm massage unit 50 performs the oscillating operation, thereby performing the massage using a gripping operation and a twisting operation which imitate the motions of the fingers and the wrist of the human hand.

According to the above-described configurations, it is possible to provide the treatment unit and the massage machine which realize the treatment having the twisting operation added thereto.

Action Pattern

Figure 13:
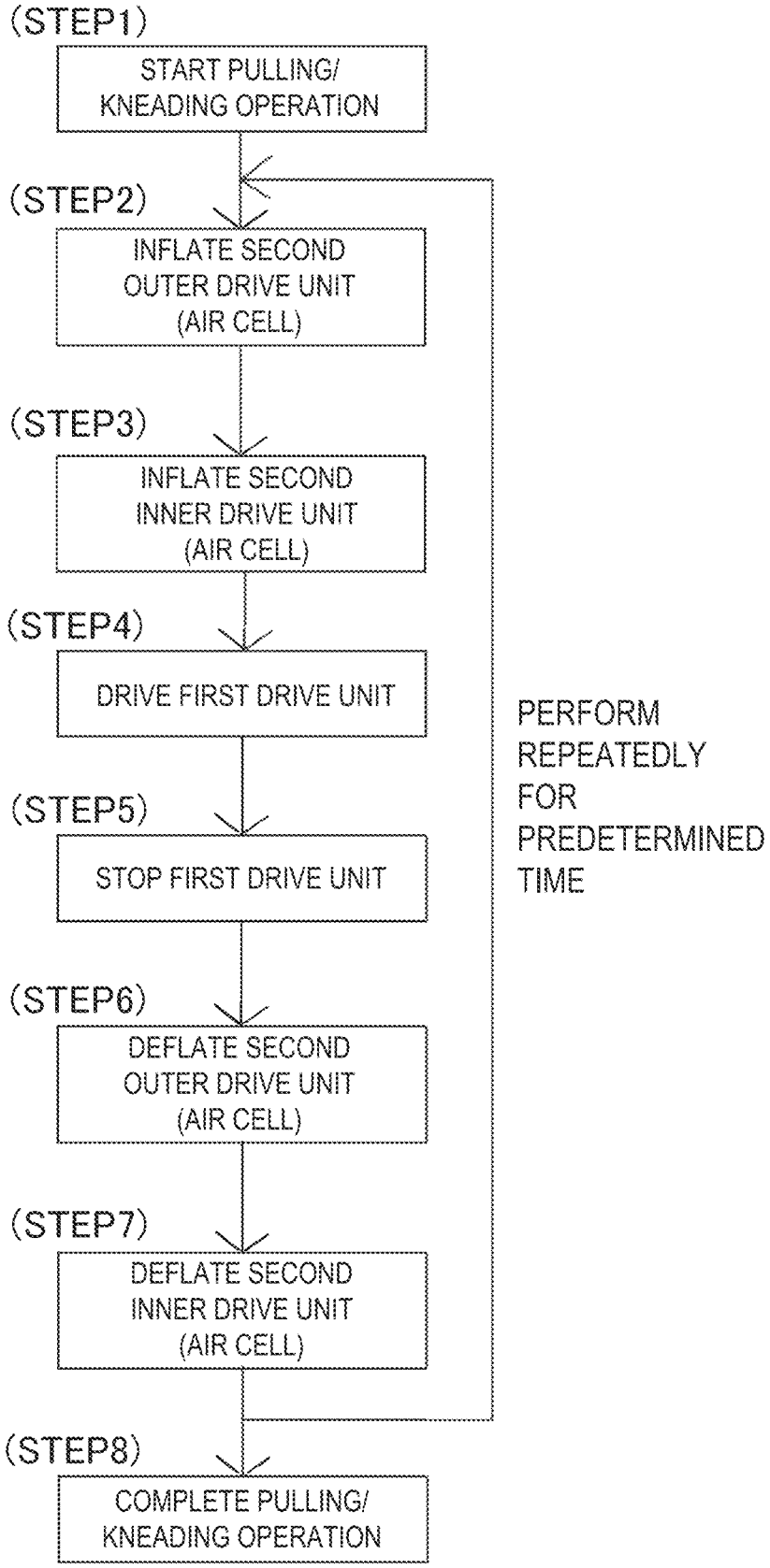
FIG. 13 is a flowchart illustrating an action pattern of the arm massage unit.

FIG. 13 is a flowchart illustrating an action pattern of the arm massage unit 50. The action pattern according to the present embodiment includes three operations such as an operation of driving the first drive unit 51 in a state where the second outer drive unit 52*a* and/or the second inner drive unit 52*b* are driven, an operation of changing the driving timings to be different from each other among the first drive unit 51, the second outer drive unit 52*a*, and the second inner drive unit 52*b*, and an operation of interlocking the drive timings with each other among the first drive unit 51, the second outer drive unit 52*a*, and the second inner drive unit 52*b*.

As illustrated in FIG. 13, the treatment target person starts a pulling/kneading operation (STEP 1). If the pulling/kneading operation starts, the air cell of the second outer drive unit 52*a* is inflated, and the outer first member 62*a* is moved in a direction closer to the treatment target person (STEP 2). Thereafter, the air cell of the second inner drive unit 52*b* is inflated, and the inner treatment unit 62*b* is moved in the direction closer to the treatment target person (STEP 3). In this state, the treatment target site of the treatment target person can be firmly gripped. In this state, the first drive unit 51 is driven (STEP 4). The first drive unit 51 is driven, thereby enabling the arm massage unit 50 to be driven in a direction extending along a direction facing the treatment target site of the treatment target person. That is, a three-dimensional massage operation can be performed. Thereafter, the first drive unit 51 stops to be driven (STEP 5). Then, the air cell of the second outer drive unit 52*a* is deflated, and the outer treatment unit 62*a* is moved in a direction away from the treatment target person (STEP 6). Thereafter, the air cell of the second inner drive unit 52*b* is deflated, and the inner treatment unit 62*b* is moved in the direction away from the treatment target person (STEP 7). After these operations are repeatedly performed for a predetermined time, the pulling/kneading operation is completed (STEP 8).

Since these operations are repeatedly performed for the predetermined time, it is possible to perform the massage reproducing the motions of the fingers and the wrist of the human hand for the treatment target site of the treatment target person.

The above-described action pattern is an example. An operation procedure of the first drive unit 51, the second outer drive unit 52*a*, and the second inner drive unit 52*b* is not limited as long as the pulling/kneading operation can be performed on the treatment target site of the treatment target person.

Other Embodiments

Figure 14:
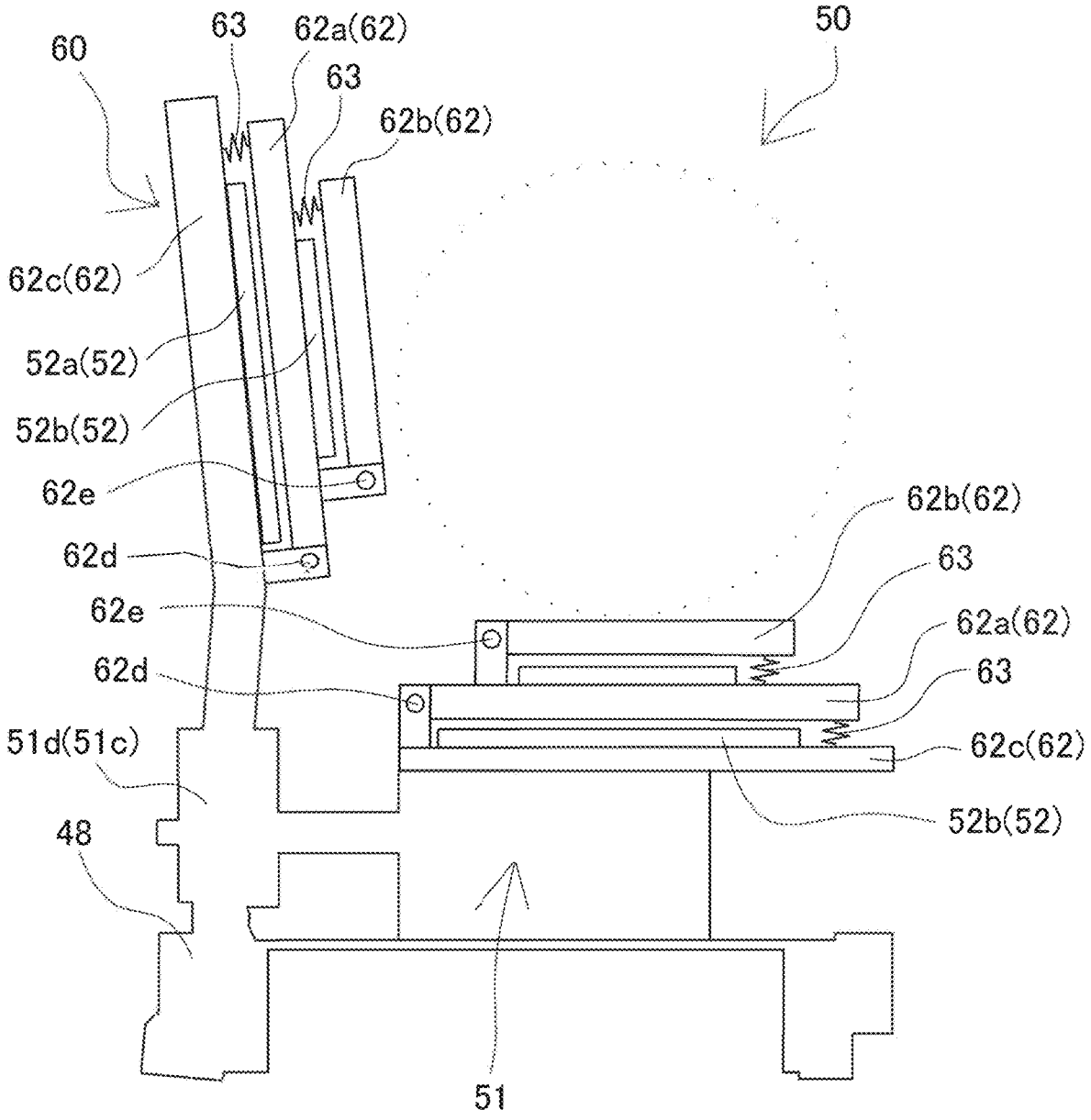
FIG. 14 is a schematic view of an arm massage unit according to another embodiment of the present invention, and illustrates the arm massage unit provided so that one treatment unit can perform massage in an upward-downward direction and the other treatment unit can perform massage in a rightward-leftward direction.

FIG. 14 is a schematic view of the arm massage unit 50 according to another embodiment of the present invention, and illustrates the arm massage unit 50 in which one of the treatment units 60 performs the massage in the upward-downward direction and the other of the treatment units 60 performs the massage in the rightward-leftward direction.

As illustrated in FIG. 14, one of the treatment units 60 (treatment unit 60 located outward) may be disposed so that the massage can be performed in the upward-downward direction, and the other of the treatment units 60 (treatment unit 60 located inward) may be disposed on the upper surface of the first drive unit 51 so that the massage can be performed in the rightward-leftward direction.

According to this configuration, the massage can be performed on the treatment target site of the treatment target person in two directions having mutually different vectors.

The other of the treatment units 60 may be attached to the first drive unit 51 via the conversion member 51*c*, similarly to one of the treatment units 60. In this manner, the other of the treatment units 60 can be driven. In addition, the massage unit 50 may be located on another body support unit such as the footrest 4. For example, since the massage unit 50 is located in the footrest 4, the massage can be performed on the lower limbs of the treatment target person in the two directions having mutually different vectors by the treatment plates 62*c* serving as the treatment unit 60 configuring the massage unit 50. In addition, since the massage unit 50 is located in the seat unit 2, the massage can be performed on the gluteal region or the femoral region of the treatment target person in the two directions having mutually different vectors by the treatment plates 62*c* serving as the treatment unit 60 configuring the massage unit 50. In addition, since the massage unit 50 is located in the backrest unit 3, the massage can be performed on the shoulders of the treatment target person in the two directions having mutually different vectors by the treatment plates 62*c* serving as the treatment unit 60 configuring the massage unit 50.

The embodiments disclosed in the present specification are examples, and the embodiments according to the present invention are not limited thereto. The embodiments can be appropriately modified within the scope not departing from the gist of the present invention. For example, the operation procedure of the first drive unit 51, the second outer drive unit 52*a*, and the second inner drive unit 52*b* may be changed. Specifically, the second outer drive unit 52*a* may be driven after the second inner drive unit 52*b* is driven. In this manner, compared to a case where the second inner drive unit 52*b* is driven after the second outer drive unit 52*a* is driven, the pulling/kneading operation can be performed on an outer side of the arm.

In addition, the massage unit 50 may be located on another body support unit such as the footrest 4. In a case where the massage unit 50 is located in the footrest 4, an arrangement is preferably adopted so that the lower limbs of the treatment target person can be pinched in the rightward-leftward direction by the treatment plates 62*c* serving as the treatment unit 60 configuring the massage unit 50. In this manner, the pulling/kneading operation can be performed on the lower limbs of the treatment target person.

In a case where the massage unit 50 is located in the seat unit 2, an arrangement is preferably adopted so that the gluteal region or the femoral region of the treatment target person can be pinched in the rightward-leftward direction by the treatment plates 62*c* serving as the treatment unit 60 configuring the massage unit 50. In this manner, the pulling/kneading operation can be performed on the gluteal region or the femoral region of the treatment target person.

In a case where the massage unit 50 is located in the backrest unit 3, an arrangement is preferably adopted so that the shoulders of the treatment target person can be pinched in the rightward-leftward direction and/or the forward-rearward direction by the treatment plates 62*c* serving as the treatment unit 60 configuring the massage unit 50. In addition, an arrangement is preferably adopted so that lateral body parts of the treatment target person can be pinched in the rightward-leftward direction by the treatment plates 62*c* serving as the treatment unit 60 configuring the massage unit 50. In this manner, the pulling/kneading operation can be performed on the shoulders, the lateral body parts, and the waist of the treatment target person.

The present invention is applicable to the massage machine including the massage unit which can reproduce the motion of the human hand and the motion of the human wrist.

Hereinbefore, the present invention has been described with reference to the embodiments, but the present invention is not limited thereto. It is obvious to those skilled in the art that various modifications, replacements, combinations and the like may be made, for example. It should be understood that the invention is not limited to the above-described embodiment, but may be modified into various forms on the basis of the spirit of the invention. Additionally, the modifications are included in the scope of the invention.

The contents of Japanese Application No. 2018-196484 filed on Oct. 18, 2018, including the specification, the claims and the drawings, are incorporated herein by reference in their entirety.

What is claimed is:

1. A massage machine comprising:

a massage unit configured to treat a treatment target person;

a first drive unit configured to drive the massage unit in a direction facing a treatment target site of the treatment target person; and a control unit configured to control driving of the first drive unit;

wherein the massage unit comprises:

a treatment unit, and a second drive unit configured to drive the treatment unit in the direction facing the treatment target site;

wherein the treatment unit comprises:

an inner treatment unit configured to face the treatment target site, a treatment plate, and an outer treatment unit between the inner treatment unit and the treatment plate, wherein the inner treatment unit is attached to the outer treatment unit, and the outer treatment unit is attached to the treatment plate;

wherein the second drive unit is between the inner treatment unit and the outer treatment unit or between the outer treatment unit and the treatment plate, wherein the outer treatment unit is attached to the treatment plate via an outer oscillating shaft so that the outer treatment unit is rotatable about the outer oscillating shaft, and wherein the inner treatment unit is attached to the outer treatment unit via an inner oscillating shaft so that the inner treatment unit is rotatable about the inner oscillating shaft;

wherein the second drive unit comprises:

a second outer drive unit between the outer treatment unit and the inner treatment unit, and a second inner drive unit between the inner treatment unit and the treatment plate;

wherein the first drive unit comprises:

a motor, a drive shaft, and an eccentric cam, wherein the drive shaft is configured to transmit a rotational movement of the motor, and the eccentric cam is configured to convert a rotational movement of the drive shaft into an oscillating movement of the treatment plate.

2. A massage machine comprising:

a massage unit configured to treat a treatment target person;

a first drive unit configured to drive the massage unit in a direction facing a treatment target site of the treatment target person; and a control unit configured to control driving of the first drive unit;

wherein the massage unit comprises:

a treatment unit, and a second drive unit that drives the treatment unit in the direction facing the treatment target site; wherein the treatment unit comprises:

an inner treatment unit configured to face the treatment site, a treatment plate, and an outer treatment unit between the inner treatment unit and the treatment plate;

wherein the inner treatment unit is attached to the outer treatment unit and the outer treatment unit is attached to the treatment plate;

wherein the second drive unit is between the inner treatment unit and the outer treatment unit or between the outer treatment unit and the treatment plate;

wherein the treatment unit comprises a biasing member between the inner treatment unit and the outer treatment unit or between the outer treatment unit and the treatment plate, the biasing member biases the inner treatment unit or the outer treatment unit in a direction away from the treatment target site;

wherein the outer treatment unit is attached to the treatment plate via an outer oscillating shaft so that the outer treatment unit is rotatable about the outer oscillating shaft;

wherein the inner treatment unit is attached to the outer treatment unit via an inner oscillating shaft so that the inner treatment unit is rotatable about the inner oscillating shaft;

wherein the first drive unit comprises:

a motor, a drive shaft, and an eccentric cam, wherein the drive shaft is configured to transmit a rotational movement of the motor, and the eccentric cam is configured to convert a rotational movement of the drive shaft into an oscillating movement of the treatment plate.

3. The massage machine according to claim 2, wherein the eccentric cam is configured to cause the treatment plate to oscillate in an upward-downward direction and a forward-rearward direction, or wherein the eccentric cam is an eccentric deflection angle cam configured to cause the treatment plate to oscillate in an upward-downward direction and a rightward-leftward direction.

* * * * *